US008483585B2

(12) United States Patent
Booth et al.

(10) Patent No.: US 8,483,585 B2
(45) Date of Patent: Jul. 9, 2013

(54) SYSTEM AND METHOD FOR ADJUSTING VOLTAGE BIAS OF A CHARGE ROLLER OF AN IMAGE FORMING DEVICE BASED ON ENVIRONMENTAL CONDITIONS TO CONTROL WHITE VECTOR

(75) Inventors: Robert Reed Booth, Lexington, KY (US); Kerry Leland Embry, Midway, KY (US); Paul Wesley Etter, Lexington, KY (US); Claudia Alexandra Marin, Lexington, KY (US); Gregorio Balandran, Broken Arrow, OK (US)

(73) Assignee: Lexmark International, Inc., Lexington, KY (US)

( * ) Notice: Subject to any disclaimer, the term of this patent is extended or adjusted under 35 U.S.C. 154(b) by 590 days.

(21) Appl. No.: 12/240,255

(22) Filed: Sep. 29, 2008

(65) Prior Publication Data

US 2010/0080585 A1 Apr. 1, 2010

(51) Int. Cl.
*G03G 15/00* (2006.01)

(52) U.S. Cl.
USPC ..... 399/44

(58) Field of Classification Search
USPC ..... 399/43, 44, 50, 222
See application file for complete search history.

(56) References Cited

U.S. PATENT DOCUMENTS 4,179,213 A * 12/1979 Queener ..... 399/46
5,148,218 A * 9/1992 Nakane et al. ..... 399/9
5,678,129 A * 10/1997 Yasuda et al. ..... 399/50
5,746,061 A 5/1998 Kramer
5,786,091 A * 7/1998 Kurokawa et al. ..... 428/421
5,799,226 A 8/1998 Shigeta et al.
6,226,469 B1 * 5/2001 Suzuki et al. ..... 399/66
6,381,425 B2 4/2002 Sasai
6,498,907 B2 12/2002 Yoda
6,658,220 B2 12/2003 Bessho et al.
7,398,025 B2 7/2008 Campbell et al.

(Continued)

FOREIGN PATENT DOCUMENTS

JP 11258923 A 9/1999
JP 2000-330400 A 11/2000
JP 2003-280302 A 10/2003
JP 2008-185705 A 8/2008

OTHER PUBLICATIONS

Notice of Allowance for related patent application, U.S. Appl. No. 12/240,199, dated Apr. 18, 2011.

(Continued)

*Primary Examiner* — Quana M Grainger

(57) ABSTRACT

A system for adjusting a selected operating parameter of an image forming device to control white vector based on selected environmental conditions includes an image forming station having a photoconductive surface with a latent image formed by discharged areas leaving non-discharged areas different from the discharged areas, a sensor mechanism for measuring selected environmental conditions of dry-bulb temperature and relative humidity, a control mechanism for reading the sensor mechanism to adjust the voltage bias of a charging unit by an offset applied to the charging unit based on a wet-bulb temperature value so as to minimize white vector without enabling onset of development of toner background on non-discharged areas, and a memory connected to and accessible by the control mechanism and storing a lookup table of a list of wet-bulb temperature values related to measured dry-bulb temperature and relative humidity values and correlated to a list of voltage bias offsets.

19 Claims, 3 Drawing Sheets

U.S. PATENT DOCUMENTS

| | | | | |
|---|---|---|---|---|
| 2005/0095023 | A1 | 5/2005 | Kyung et al. | |
| 2005/0158061 | A1* | 7/2005 | Do | 399/44 |
| 2007/0047988 | A1 | 3/2007 | Comstock | |
| 2007/0077081 | A1* | 4/2007 | Campbell et al. | 399/49 |
| 2010/0080584 | A1 | 4/2010 | Booth et al. | |
| 2010/0080586 | A1 | 4/2010 | Booth et al. | |
| 2010/0080587 | A1* | 4/2010 | Booth et al. | 399/44 |

OTHER PUBLICATIONS

Notice of Allowance for related patent application, U.S. Appl. No. 12/240,495, dated Jun. 3, 2011.

* cited by examiner

| WETBULB (°C) | CRV ENV. OFFSET (V) |
|---|---|
| 6 | -70 |
| 16 | 0 |
| 22 | +20 |

SYSTEM AND METHOD FOR ADJUSTING VOLTAGE BIAS OF A CHARGE ROLLER OF AN IMAGE FORMING DEVICE BASED ON ENVIRONMENTAL CONDITIONS TO CONTROL WHITE VECTOR

CROSS REFERENCES TO RELATED APPLICATIONS

None.

BACKGROUND

1. Field of the Invention

The present invention relates generally to an electrophotographic (EP) image forming device and, more particularly, to a system and method for adjusting a selected operating parameter, namely bias voltage of the charge roll, of the image forming device based on selected environmental conditions, namely, wet-bulb temperature values derived from dry-bulb temperature and relative humidity sensor readings, to control white vector, the difference in surface potential of non-discharged areas of a photoconductive (PC) drum from surface potential of a developer roll, and thereby reduce background toner.

2. Description of the Related Art

The electrophotography (EP) process used in image forming devices, such as laser printers and copiers, utilizes electrical potentials between components to control the transfer and placement of toner. These electrical potentials create attractive and repulsive forces that tend to promote the transfer of charged toner to desired areas while ideally preventing transfer of the toner to unwanted areas. For instance, during the process of developing a latent image on the surface of a PC drum, negatively charged toner particles deposit onto less negatively charged (positive relative to the toner's charge) latent image feature areas (e.g., corresponding to text or graphics) on the PC drum surface. At the same time, the negatively charged toner particles are prevented from transferring or migrating to more negatively charged areas (e.g., corresponding to the document background) of the same PC drum surface. In this manner, image forming devices implementing this process can simultaneously generate images with fine detail while maintaining clean backgrounds.

In general, a laser imaging source is used to illuminate and selectively discharge the desired areas of the PC drum surface to create the latent image so that it will have a lower surface potential than the remaining, undischarged areas of the PC drum surface. The developer roll, where a layer of charged toner is located, is biased to an intermediate level between the discharge potential of the latent image and the surface potential of the undischarged areas of the PC drum surface. The toner can be charged triboelectrically and/or via biased roll delivery control components, such as a toner adder roll, a doctor blade, and a developer roll. The developer roll supplies toner to develop the latent image areas on the PC drum surface. The developed image is ultimately transferred onto a media sheet, typically by employing yet another surface potential that attracts the toner off of the PC drum surface (or an intermediate transfer surface) and onto the media sheet where it is ultimately fused.

The difference between the surface potential of the developer roll and the surface potential of undischarged areas of the PC drum surface is referred to as a white vector. An optimal white vector achieves certain desirable characteristics, one of which is to provide a clean media sheet with little or no appreciable background toner in areas other than where printing is desired. The magnitude of the white vector needed to prevent background toner is a function of numerous factors, including developer material, environment, imaging device components, and age. Traditionally, image forming devices incorporating an EP process operate with a white vector that is fixed, but large enough to overcome the factors that contribute to unwanted background toner.

Very large white vector values are not necessarily the most desirable solution because the density of deposited toner and detail of the resulting image may be adversely affected and could lead to background toner if wrong-sign toner (toner charged positively) is present. Conversely, as white vector values fall, unwanted background toner may begin to appear. Determining an optimal white vector that is somewhere between these extremes and that accounts for the aforementioned factors and varying operating conditions is a legitimate problem that is not solved by setting a fixed operating point.

Although a majority of image forming devices, such as laser printers, operates in an air-conditioned office environment, such environment may not necessarily be controlled for humidity. It is important that a printer yields high print quality over a wide range of environments. As temperature and humidity of the ambient environment change, the electrical properties of printer components can also change which can have a significant impact on print quality. Heretofore, "cold start" servo voltage has been used to select or adjust charge roll bias. Cold start servo voltages are the servo values recorded when the printer is first powered on or after the printer has been idle. However, print quality requirements have made servo algorithms not accurate enough for optimizing charge roll bias to minimize background toner in all environments.

One approach to resolving this problem of controlling white vector is disclosed in U.S. Pat. No. 7,398,025 assigned to the assignee of the present application. The entire disclosure of this patent is hereby incorporated herein by reference. This patent proposes to control and adjust white vector by using one or more control circuits adapted to control the formation of a given image pattern on a substrate, such as a transport belt, transfer belt, or media sheet. The circuits utilize sensors to detect the coverage of the developed image pattern on the PC drum surface or on the substrate. White vector may then be adjusted in response to a comparison between the detected coverage of the developed image and the desired coverage of the developed image. In one embodiment, background noise is used as an indicator that white vector needs to be adjusted. In another embodiment, reflectance of a developed pattern is used to detect the coverage or bloom of the pattern relative to a predetermined standard. Iterative procedures also are used to determine an optimum operating point.

While the approach of this patent might represent a step in the right direction toward resolution of this problem, its implementation is not always feasible requiring an innovation that will provide an alternative approach to its resolution.

SUMMARY OF THE INVENTION

The present invention meets this need by providing an innovation that is directed to a more general or global approach to the resolution of the problem of controlling white vector. This approach dispenses with sensing the current condition of white vector in a developed pattern in comparison to a given desired pattern. Instead, this approach is directed toward adjusting an operating parameter, namely, the bias voltage of the charge roll, based on a wet-bulb temperature value derived from dry-bulb temperature and relative humidity readings from sensors of current environmental conditions, by application of an offset voltage value, correlated to the wet-bulb temperature value, instead of the currently-practiced cold start servo voltage. This offset adjustment will allow for better charge roll voltage optimization and optimal white vector control and thus better print quality, obviating the need to sense and then adjust the current condition of white vector in a developed pattern.

Accordingly, in an aspect of the present invention, a system for adjusting a selected operating parameter of an image forming device based on selected environmental conditions to control white vector includes a photoconductive unit, a charging unit having a surface biased to a voltage operative to charge a surface of the photoconductive unit, an imaging unit forming a latent image on areas of the surface of the photoconductive unit by selectively discharging the areas of the surface thereof by illumination thereof, leaving non-discharged areas of the surface different from the discharged areas thereof, a developer unit having a surface biased to a voltage operative to develop toner to the latent image on the discharged areas of the surface of the photoconductive unit, a sensor mechanism for measuring selected environmental conditions of dry-bulb temperature and relative humidity, a control mechanism for reading the sensor mechanism to adjust the voltage bias of the charging unit by applying an offset thereto based on a wet-bulb temperature value so as to minimize a white vector represented by the difference in potential between non-discharged areas on the surface of the photoconductive unit and the surface potential of the developer roll without enabling onset of development of toner background on the non-discharged areas of the surface of the photoconductive unit, and a memory connected to and accessible by the control mechanism and having stored therein lists of correlated values comprising a list of wet-bulb temperature values related to values of dry-bulb temperature and relative humidity measured by the sensor mechanism correlated to a list of voltage bias offsets related to the voltage bias of the charging unit to control the white vector.

In another aspect of the present invention, a method for adjusting a selected operating parameter of an image forming device based on selected environmental conditions to control white vector includes biasing a charging unit to a voltage operable to charge a surface of a photoconductive unit, discharging selected areas on the surface of the photoconductive unit to form a latent image thereon leaving non-discharged areas different from the discharged areas, biasing a developer unit to a voltage operative to develop with toner the latent image on the discharged areas of the surface of the photoconductive unit, sensing selected environmental conditions of dry-bulb temperature and relative humidity so as to determine wet-bulb temperature values correlated with said dry-bulb temperature and relative humidity, and adjusting the voltage bias of the charging unit by applying an offset thereto correlated to one of the wet-bulb temperature values so as to minimize white vector without enabling onset of development of toner background on the non-discharged areas of the surface of the photoconductive unit. The method further includes storing a lookup table in memory of a list of wet-bulb temperature values correlated to a list of voltage bias offsets, and accessing the lookup table from memory with a wet-bulb temperature value to determine a correlated value of voltage offset biases to apply to the charging unit.

BRIEF DESCRIPTION OF THE DRAWINGS

Figure 1:
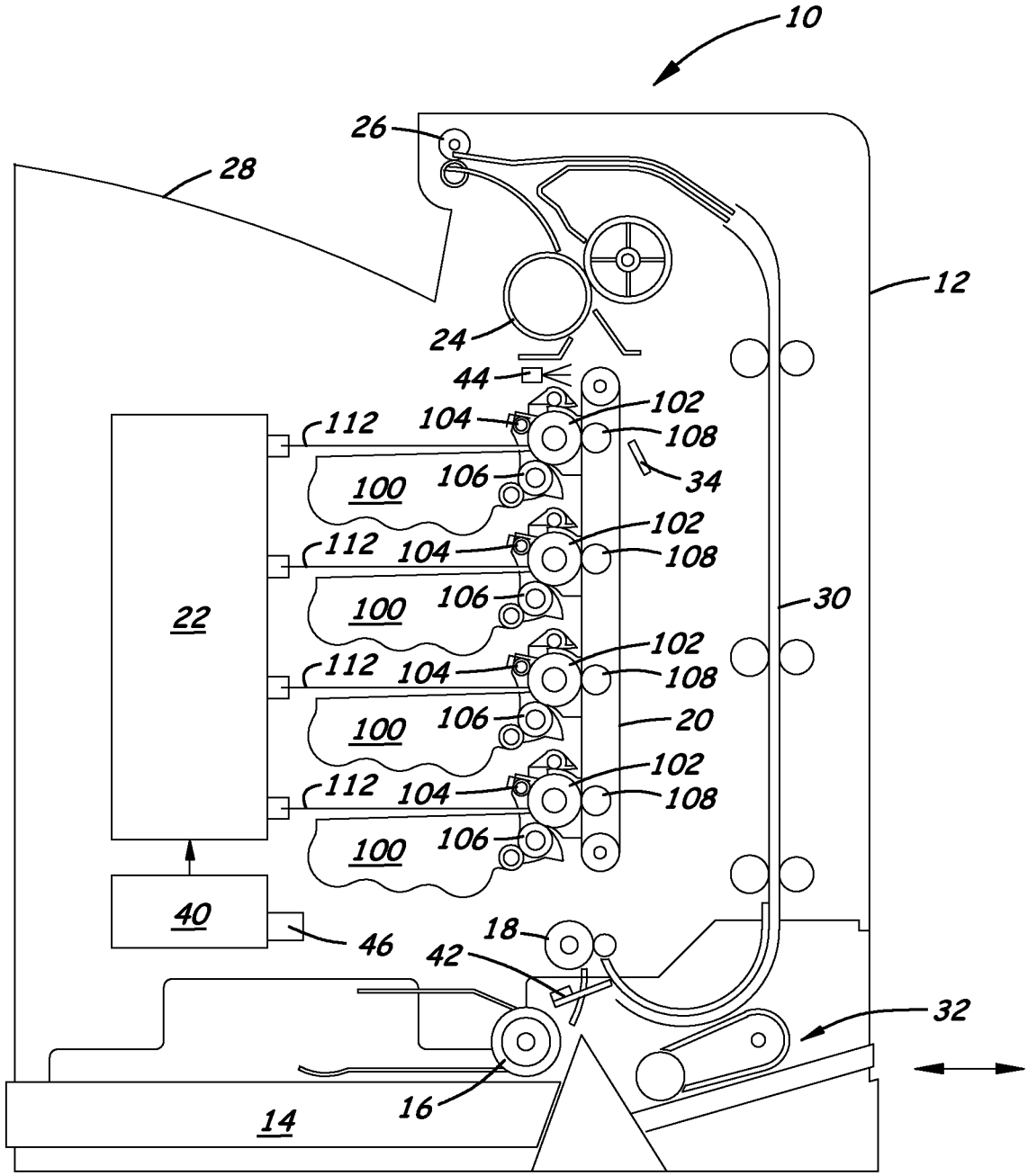

Having thus described the invention in general terms, reference will now be made to the accompanying drawings, which are not necessarily drawn to scale, and wherein:

FIG. 1 is a schematic view of an EP image forming device to which is applied the system and method of the present invention for adjusting a selected operating parameter of the image forming device to improve control of white vector and reduce background toner.

Figure 2:
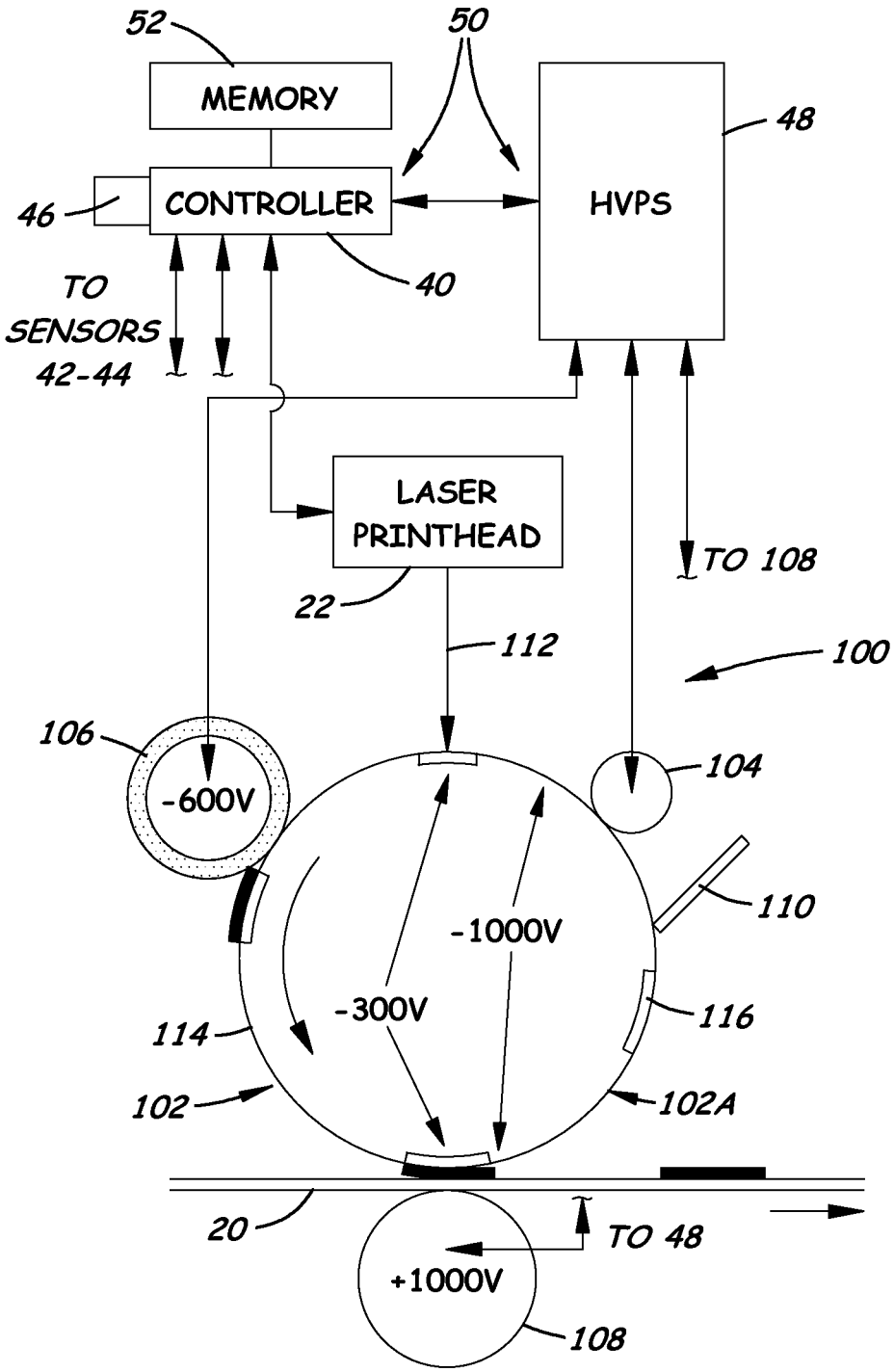

FIG. 2 is a schematic view of one of the image forming stations in the device according to one embodiment of the present invention.

Figures 3, 4:
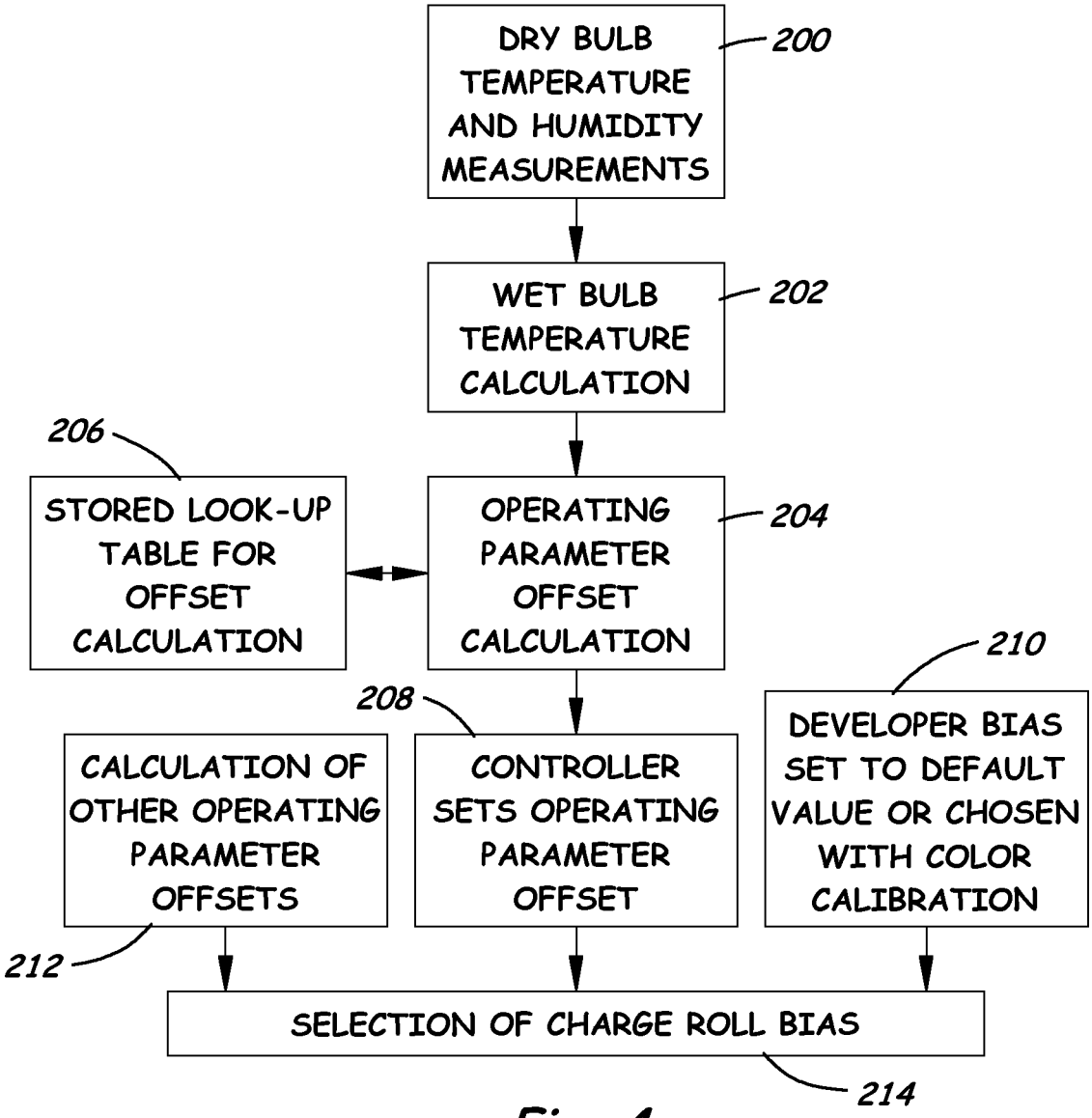

FIG. 3 is a representative lookup table showing the charge roll voltage adjustment or offset values correlated with various wet-bulb temperatures according to one embodiment of the present invention.

FIG. 4 is a flow diagram illustrating a method by which the selected operating parameter of the image forming device may be adjusted in response to a detected wet-bulb temperature according to one embodiment of the present invention.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

Referring now to FIG. 1, there is schematically illustrated an EP image forming device, generally designated 10, to which the system and method of the present invention are applicable. The exemplary image forming device 10, which is a laser printer, includes a main body 12, at least one media tray 14, a pick mechanism 16, a registration roller 18, a media transport belt 20, a laser printhead 22, a plurality of image forming stations 100, a fuser roller 24, exit rollers 26, an output tray 28, a duplex path 30, an auxiliary feed 32, and a cleaning blade 34. The media tray 14, disposed in a lower portion of the main body 12, contains a stack of print media on which images are to be formed. Pick mechanism 16 picks up media sheets from the top of the media stack in the media tray 14 and feeds the print media into a primary media path. Registration roller 18, disposed along a media path aligns the print media and precisely controls its further movement along the media path. Media transport belt 20 transports the print media along the media path past a series of image forming stations 100, which apply toner images to the print media.

Color printers typically include four image forming stations 100 for printing with cyan, magenta, yellow, and black toner to produce a four-color image on the media sheet. The media transport belt 20 conveys the print media with the color image thereon to the fuser roller 24, which fixes the color image on the print media. Exit rollers 26 either eject the print media to the output tray 28, or direct it into a duplex path 30 for printing on a second side of the print media. In the latter case, the exit rollers 26 partially eject the print media and then reverse direction to invert the print media and direct it into the duplex path. A series of rollers in the duplex path 30 return the inverted print media to the primary media path for printing on the second side. Also, the auxiliary feed 32 of the image forming device 10 may be utilized to manually feed media sheets into the device 10.

Turning now to FIG. 2, there is a schematic diagram illustrating an exemplary embodiment of one of the image forming stations 100. Each image forming station 100 includes a photoconductor (PC) unit in the form of a PC drum 102, a charging unit in the form of a charge roll 104, a developer unit in the form of a developer roll 106, a transfer unit 108, and a cleaning blade 110. The charge roll 104 charges the surface of the PC drum 102 to approximately −800 v. An optical scanning device in the form of a laser beam 112 illuminates the PC drum 102 to discharge areas thereon to approximately −300 v to form a latent image on the surface of the PC drum 102. The PC drum core is held at −200 v. The developer roll 106 transfers negatively-charged toner having a core voltage of approximately −600 v to the surface of the PC drum 102 to develop the latent image on the PC drum 102. The toner is attracted to the most positive surface area, ie., the area discharged by the laser beam 112. As the PC drum 102 rotates, a positive voltage field produced by the transfer unit 108 attracts and transfers the toner on the PC drum 102 to the media sheet. Alternatively, the toner images could be transferred to an ITM belt and subsequently from the ITM belt to the media sheet. Any remaining toner on the PC drum 102 is then removed by the cleaning blade 110. The transfer unit 108 may include a roll, a transfer corona, transfer belts, or multiple transfer devices, such as multiple transfer rolls.

Referring to both FIGS. 1 and 2, a controller 40 controls the operation of the image forming device 10. The functions of the controller 40 include timing control and control of image formation. To perform these functions, the controller 40 receives input from a sheet detection sensor 42, a registration sensor 44 and, in accordance with the present invention, also receives inputs from a sensor mechanism 46 having sensor(s) therein capable of measuring ambient dry-bulb temperature and relative humidity. By way of example only, the sensor mechanism 46 is mounted directly on a circuit board at the rear of the device 10. Other mounting arrangements and locations are possible. The controller 40 for this sensor mechanism 46 is also contained within this circuit board and electrically connected to the sensor mechanism 46. The controller 40 controls the timing of the registration roller 18 and media transport belt 20 based on signals from the sheet detection sensor 42 to feed the media sheets with proper timing to the image forming stations 100. The controller 40 is electrically connected to a high voltage power supply (HVPS) 48 and together therewith provide a control mechanism 50. The HVPS 48 in turn is electrically connected to the charge roll 104 and developer roll 106. The charge roll 104 is electrified to a predetermined servo voltage bias by the HVPS 48 that is adjusted or turned on and off by the controller 40. As mentioned above, the charge roll 104 applies an electrical charge to the surface of the PC drum 102 which charges the entire surface in preparation of selected areas being discharged by the laser beam 112 to create the latent image. The developer roll 106 (and hence, the toner thereon) is charged to a voltage bias level by the HVPS 50 that is advantageously set between the voltage of the non-discharged areas 114 of the PC drum surface 102A and the discharged latent image. As a result of the imposed voltage bias differences, the toner carried by the developer roll 106 to the PC drum 102 is attracted to the latent image and repelled from the remaining higher charged areas of the PC drum 102. At this point in the image formation process, the latent image is said to be developed.

The non-discharged areas 114 of the surface 102A of the PC drum 102 that are not part of the discharged areas 116 forming the latent image and not to be developed by toner, which are referred to as "white" or "background" image areas, retain the potential induced by the charge roll 104, e.g., approximately −800 v in the illustrated embodiment. As a result, toner is repelled from these white image areas 114 on the surface 102A of the PC drum 102 and consequently toner does not adhere to these areas. The difference in potential between non-discharged areas 114 on the surface 102A of the PC drum 102, that is, white image areas or areas not to be developed by toner, and the surface potential of the developer roll 106 is known as white vector, as explained hereinabove. A sufficiently high white vector is necessary to prevent toner development in the white image areas 114; however, an overly large white vector affects detrimentally the formation of fine image features, such as dots and lines and could lead to a wrong-sign toner background. Typically, a white vector of 200-250 v results in acceptable image quality while preventing toner development in white image areas. Unfortunately, the charge roll bias voltage required for obtaining a certain white vector and the optimal white vector itself vary due to environmental conditions, such as dry-bulb temperature and relative humidity.

The controller 40 employs a charge roll environmental offset to minimize the white vector between the developer roll 106 and the surface 102A of the charged PC drum 102 so as to reduce wrong-sign toner background while preventing onset of development or background toner on the non-discharged areas 114. Previously the charge roll voltage bias was set based on the cold start servo voltage. Cold start servo voltages are the servo values recorded when the printer is first powered on or after the printer has been idle. In order to establish an algorithm for adjusting the charge roll voltage using dry-bulb temperature and relative humidity readings, different outputs were correlated to changes in EP performance over a range of environments. The intent was to minimize the white vector while preventing the onset of development background (i.e. toner development when the PC drum 102 is not charged high enough). The shift in the onset of development over a range of environments showed a correlation with wet-bulb temperature.

The charge roll environmental offset established by the algorithm for adjusting the charge roll voltage using wet-bulb temperature values are provided in a lookup table set forth in FIG. 3 in accordance with the present invention which is stored in a memory 52 connected to the controller 40. The controller 40 adjusts the voltage bias of the charge roll 104 via the HVPS 48 based on certain environmental conditions, namely, wet-bulb temperature calculated from ambient dry-bulb temperature and relative humidity as measured by sensor mechanism 46. In the lookup table, a set of wet-bulb temperature values are listed that correlate to sets of voltage bias offset values that are to be used to offset or adjust the voltage bias of the charge roll 104 at each of the image forming stations 100 in order to minimize white vector. The actual charge environmental offset to be applied is determined using a linear interpolation between the two surrounding wet-bulb temperature values in the lookup table. If the wet-bulb temperature is smaller than the minimum or greater than the maximum values shown in the lookup table, the minimum or maximum offsets are to be used. The developer roll bias is established relative to the discharge bias of the latent image on the PC drum surface, so that the white vector may be determined relative to the developer roll bias. That is, the white vector is affected by adjusting or offsetting the bias level charge roll 104 while maintaining a fixed developer roll 106 bias.

By way of further explanation, web-bulb temperature is the temperature of a volume of air that is cooled to saturation at constant pressure by evaporating water into the air without adding or removing heat. A wet-bulb thermometer approximates wet-bulb temperature by measuring the temperature of the tip of the thermometer covered by a wet cloth. When the relative humidity is below 100%, water evaporates from the cloth and effectively cools the tip of the wet-bulb thermometer. Essentially, wet-bulb temperature is a quantity that combines temperature and humidity into a single value that can be used to differentiate one environmental condition from another. Though temperature and humidity measurements change significantly within the first several minutes of printing, wet-bulb temperature does not change significantly for a given environment, and serves as a quantity that can be used to determine ambient environmental conditions regardless of internal machine temperature. Iterative numerical-methods techniques were used to fit a quadratic surface to data taken from a psychrometric chart. The quadratic surface establishes an orthogonal relationship for dry-bulb temperature, relative humidity, and wet-bulb temperature. A best fit quadratic surface to approximate wet-bulb temperature as a function of dry-bulb temperature and relative humidity can be written in the following form: $Z=AX^2+BY^2+CXY+DX+EY+F$; where: $A=-0.00079$, $B=-0.00047$, $C=0.00479$, $D=0.59473$, $E=0.1003$, and $F=-6.32789$; and: X=Dry-bulb Temperature (° C.) read from a thermistor, Y=Relative Humidity (% RH), and Z=Wet-bulb Temperature (° C.).

Turning to FIG. 4, there is illustrate a flow diagram illustrating one exemplary embodiment of a method by which the aforementioned selected operating parameter, namely, the voltage bias applied on the charge roll 104, may be adjusted or offset to improve white vector control by the image forming device 10 based on the aforementioned selected environmental conditions, namely, the wet-bulb temperature as derived from dry-bulb temperature and relative humidity. In step 200, a routine is initiated by which measurements made of dry-bulb temperature and relative humidity by the sensor mechanism 46 are read by the controller 40. In step 202, the wet-bulb temperature that correlates to the readings of sensor mechanism 46 is determined. In step 204, the offset value of the selected operating parameter of the device 10, namely the offset voltage bias of the charge roll 104 is determined from the previously stored lookup table or map in memory 52 (step 206) using the wet-bulb temperature determined in step 202 to retrieve the correct offset value for this operating parameter. In step 208, the controller 40 will set the operating parameter accordingly for carrying out desired control of the white vector by adjusting or offsetting the voltage bias of the charge roll 104 at each of the image forming stations 100 to the value contained in the lookup table that correlates to the applicable wet-bulb temperature determined in step 202. The developer bias voltage chosen by Color Calibration or set to a default value in Step 210, as well as other offsets to the Charge roll voltage will be used to set the voltage bias of charge roll 104 in step 214.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A system for adjusting a selected operating parameter of an image forming device to control white vector based on selected environmental conditions, comprising:

a photoconductive unit;

a charging unit having a surface biased to a voltage operative to charge a surface of said photoconductive unit;

an imaging unit forming a latent image on areas of said surface of said photoconductive unit by selectively discharging said areas of said surface thereof by illumination thereof, leaving non-discharged areas of said surface different from said discharged areas thereof;

a developer roll having a surface biased to a voltage operative to develop toner to said latent image on said discharged areas of said surface of the photoconductive unit;

a sensor mechanism for measuring selected environmental conditions of dry-bulb temperature and relative humidity;

a control mechanism for reading said sensor mechanism to adjust said voltage bias of said charging unit by applying an offset thereto based on a wet-bulb temperature value so as to substantially minimize a white vector represented by the difference in potential between said non-discharged areas on said surface of said photoconductive unit and surface potential of said developer roll, the substantially minimizing being performed without enabling onset of development of toner background on said non-discharged areas of said surface of said photoconductive unit; and a memory connected to and accessible by said control mechanism and having stored therein lists of correlated values comprising a list of wet-bulb temperature values related to values of dry-bulb temperature and relative humidity measured by said sensor mechanism correlated to a list of voltage bias offsets related to the voltage bias of said charging unit to control said white vector.

2. The system of claim 1 wherein said sensor mechanism is electrically connected to said control mechanism.

3. The system of claim 1 wherein said control mechanism includes a controller.

4. The system of claim 3 wherein said sensor mechanism is disposed adjacent to said controller.

5. The system of claim 1 wherein said lists of correlated values are stored in a lookup table in said memory.

6. The system of claim 3 wherein said control mechanism also includes a high voltage power supply electrically connected to said controller.

7. The system of claim 3 wherein said sensor mechanism is electrically connected to said controller.

8. The system of claim 6 wherein said high voltage power supply is interposed and electrically connected between said controller and said charging unit and developer roll.

9. The system of claim 3 wherein said sensor mechanism includes a sensor for measuring dry-bulb temperature disposed adjacent to said controller.

10. The system of claim 3 wherein said sensor mechanism includes a sensor for measuring relative humidity disposed adjacent to said controller.

11. A method for adjusting a selected operating parameter of an image forming device to control white vector based on selected environmental conditions, comprising:

biasing a charging unit to an operable voltage to charge a surface of a photoconductive unit;

discharging selected areas on the surface of the photoconductive unit to form a latent image thereon leaving non-discharged areas different from the discharged areas;

biasing a developer unit to a voltage operative to develop with toner the latent image on the discharged areas of the surface of the photoconductive unit;

sensing selected environmental conditions of dry-bulb temperature and relative humidity so as to determine wet-bulb temperature values correlated with said dry-bulb temperature and relative humidity; and adjusting the voltage bias of the charging unit by applying an offset thereto correlated to one of the wet-bulb temperature values so as to reduce white vector without enabling onset of development of toner background on the non-discharged areas of the surface of the photoconductive unit.

12. The method of claim 11 further comprising storing a lookup table in memory of a list of wet-bulb temperature values correlated to a list of voltage bias offsets.

13. The method of claim 12 further comprising accessing the lookup table in memory with a wet-bulb temperature value to determine a correlated value of voltage offset biases to apply to the charging unit.

14. An image forming device, comprising:

a photoconductive unit;

a charging unit having a surface biased to a voltage operative to charge a surface of said photoconductive unit;

a developer roll having a surface biased to a voltage operative to develop toner on the surface of the photoconductive unit;

a sensor mechanism for measuring environmental conditions;

a controller for adjusting the voltage bias of the charging unit based on a wet-bulb temperature value so as to reduce a white vector represented by a difference in potential between non-discharged areas on the surface of the photoconductive unit and surface potential of the developer roll; and a memory connected to and accessible by the controller and having stored therein lists of correlated values comprising a list of wet-bulb temperature values related to values of dry-bulb temperature and relative humidity measured by said sensor mechanism correlated to a list of voltage bias offsets related to the voltage bias of said charging unit to control said white vector.

15. The image forming device of claim 14, wherein the controller adjusts the voltage bias of the charging unit by applying an offset thereto based on the wet-bulb temperature value.

16. The image forming device of claim 14, wherein the voltage bias of the charging unit is adjusted while maintaining the voltage bias of the developer roll substantially fixed.

17. The system of claim 1, wherein said surface of said developer roll is biased to a substantially fixed voltage operative to develop toner to said latent image on said discharged areas of said surface of the photoconductive unit.

18. The system of claim 1, wherein the controller uses linear interpolation for determining a voltage bias offset corresponding to a wet-bulb temperature falling between two surrounding web-bulb temperature values in the lists, and uses maximum and minimum voltage bias offset values when a wet-bulb temperature is greater than and less than, respectively, wet-bulb temperature values in the list.

19. The method of claim 11, wherein biasing said developer unit comprises biasing said developer unit to a fixed voltage operative to develop with toner the latent image on the discharged areas of the surface of the photoconductive unit.

* * * * *